US006752262B1

(12) United States Patent
Boriani et al.

(10) Patent No.: US 6,752,262 B1
(45) Date of Patent: Jun. 22, 2004

(54) FLAT BLANK FOR THE FORMATION OF A RIGID CARTON FOR CIGARETTE PACKETS

(75) Inventors: Silvano Boriani, Bologna (IT); Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 221 days.

(21) Appl. No.: 10/148,423

(22) PCT Filed: Nov. 28, 2000

(86) PCT No.: PCT/IB00/01766

§ 371 (c)(1),
(2), (4) Date: May 31, 2002

(87) PCT Pub. No.: WO01/40062

PCT Pub. Date: Jun. 7, 2001

(30) Foreign Application Priority Data

Dec. 1, 1999 (IT) ..... BO99A0659

(51) Int. Cl.[7] ..... B65D 5/52

(52) U.S. Cl. ..... 206/45.21; 206/45.25; 206/494; 206/273; 206/736; 229/235; 229/237

(58) Field of Search ..... 206/273, 271, 206/274, 275, 276, 256, 264, 736, 774, 494, 746, 45.21, 45.25, 45.23, 45.26, 45.29; 229/235, 237, 240, 241, 242, 164, 120.011, 123.2; 221/305

(56) References Cited

U.S. PATENT DOCUMENTS

| | | | | | |
|---|---|---|---|---|---|
| 1,416,465 | A | * | 5/1922 | William | 206/45.21 |
| 2,115,269 | A | * | 4/1938 | Lane | 206/742 |
| 2,260,428 | A | * | 10/1941 | Barr et al. | 206/760 |
| 3,568,911 | A | * | 3/1971 | Bebout | 206/738 |
| 5,577,612 | A | * | 11/1996 | Chesson et al. | 206/494 |
| 5,690,230 | A | * | 11/1997 | Griffith | 206/555 |
| 5,924,559 | A | | 7/1999 | Carrel et al. | |

FOREIGN PATENT DOCUMENTS

| | | |
|---|---|---|
| DE | 9300738 | 6/1993 |
| EP | 0084832 | 8/1983 |

* cited by examiner

*Primary Examiner*—Jila M. Mohandesi
(74) *Attorney, Agent, or Firm*—Davidson Berquist Klima & Jackson, LLP

(57) ABSTRACT

A flat blank (1; 25) for the formation of a rigid carton (2; 26) having the shape of a parallelepiped, in which two panels (5', 8') form a front wall (5) and, respectively, a lid (8) on the carton (2; 26), and in which the panel (5') which forms the front wall (5) is divided by a pre-wakened tear line (10) into a first and a second portion (11', 12'); and the panel (8') which forms the lid (8) is divided by a fold line (13; 29) into a first and second portion (14', 27'; 15', 28'), the first portion (14', 27') being adjacent to the panel (5') that forms the front wall (5).

14 Claims, 4 Drawing Sheets

FLAT BLANK FOR THE FORMATION OF A RIGID CARTON FOR CIGARETTE PACKETS

TECHNICAL FIELD

This application is the National Phase of International Application PCT/IB00/01766 filed Nov. 28, 2000 which designated the U.S. and that International Application was published under PCT Article 21(2) in English.

The present invention relates to a flat blank for the formation of a rigid carton for cigarette packets.

In particular, the present invention relates to a flat blank for the formation of a rigid display carton designed to contain a group of ten packets of cigarettes.

BACKGROUND ART

It is known that rigid display cartons are made which comprise portions which are torn off upon first opening the carton, to allow the packets inside to be seen.

Such a type of carton is known from document U.S. Pat. No. 5924559 which discloses a multiuse carton formed by first and second base panels separated from each other by side walls and end walls to form an interior space in which a plurality of items are arranged in rows. The carton further includes a hinged tear away portion panel for exposing the items in the carton for display.

However, the above-mentioned known type of rigid display cartons are normally made from blanks whose shape make them difficult to machine and, therefore, production of the display cartons necessitates substantial modification to the construction of existing cartoning machines.

DISCLOSURE OF THE INVENTION

The aim of the present invention is to provide a flat blank which is free of the above-mentioned disadvantages and which, in particular, is easily machined and allows the production of a rigid display carton by means of simple modifications to existing cartoning machines.

Accordingly, the present invention provides a flat blank for the formation of a rigid carton for cigarette packets, which is substantially the shape of a parallelepiped. The carton comprises a front wall, a rear wall, two side walls, a lid and a base. The blank has a longitudinal axis and comprises a central part delimited by two longitudinal fold lines which are parallel with the longitudinal axis and two side parts located on opposite sides of the central part. The blank also comprises a set of transversal fold lines, which divide the central part into a first panel which forms the base, a second panel which forms the front wall, a third panel which forms the lid and a fourth panel which forms the rear wall. The second panel is divided into a substantially trapezoidal and a second portion by a pre-weakened tear line. The third panel is divided by a fold line into a first portion adjacent to the second panel and a second portion adjacent to the fourth panel. The side walls comprise two fifth panels located on opposite sides of the first panel and forming the side walls.

The second panel has respective first vertices located on the longitudinal fold lines in contact with the third panel. The blank is characterized in that the pre-weakened line has a central segment which is parallel with the tranversal fold lines, and two side segments that join the central segment to the two first vertices.

The present invention is now described with reference to the accompanying drawings, which illustrate preferred embodiments, of it without limiting the scope of its application, and in which.

Figure 1:
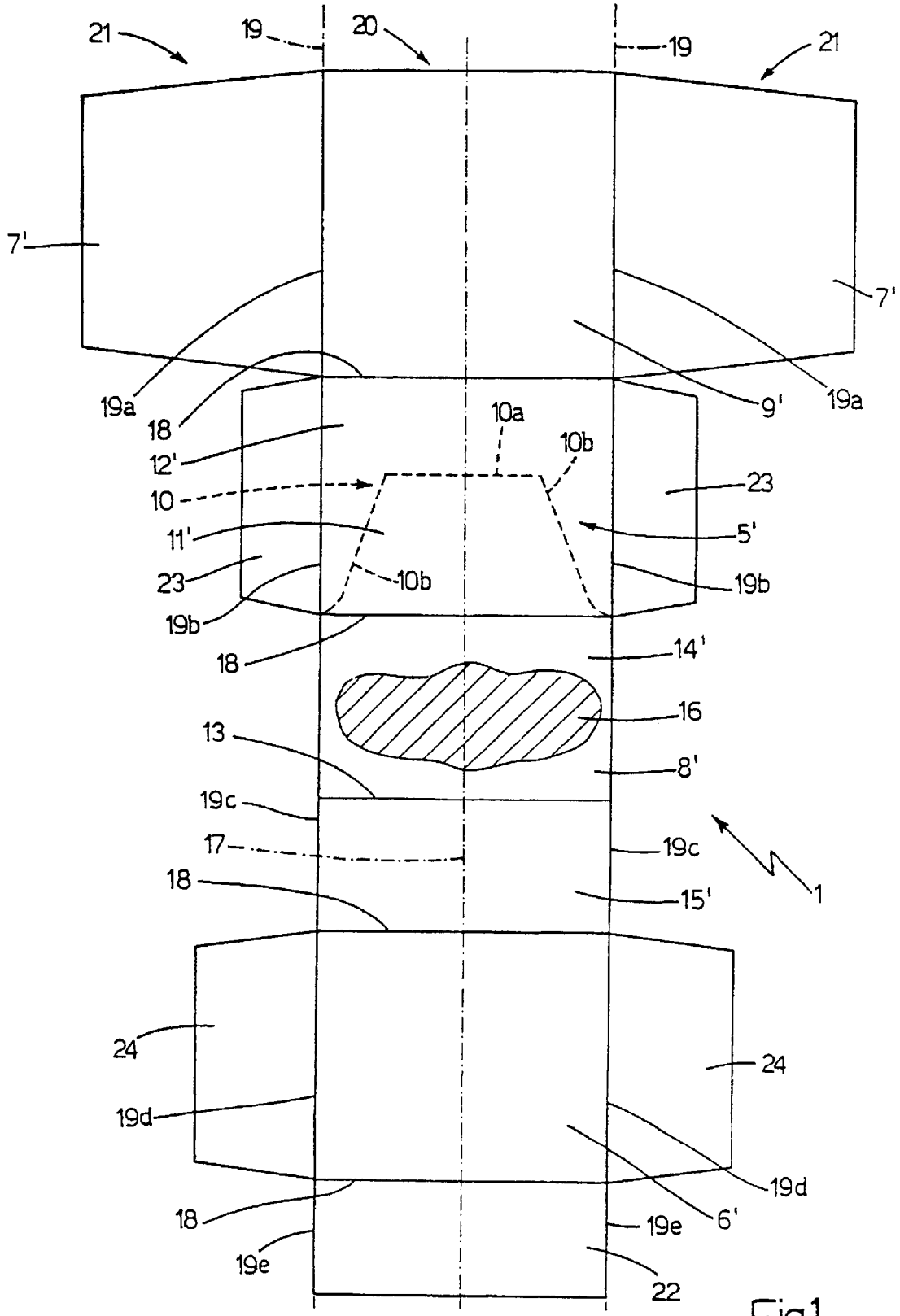
FIG. 1 is a plan view of a preferred embodiment of the blank made according to the present invention.

In FIG. 1 the numeral 1 denotes as a whole a flat blank made of cardboard or a similar material, which may be folded in the known way to make a carton 2 (FIGS. 3 and 5) which is substantially rigid and holds a group 3 of ten cigarette packets 4.

Figure 3:
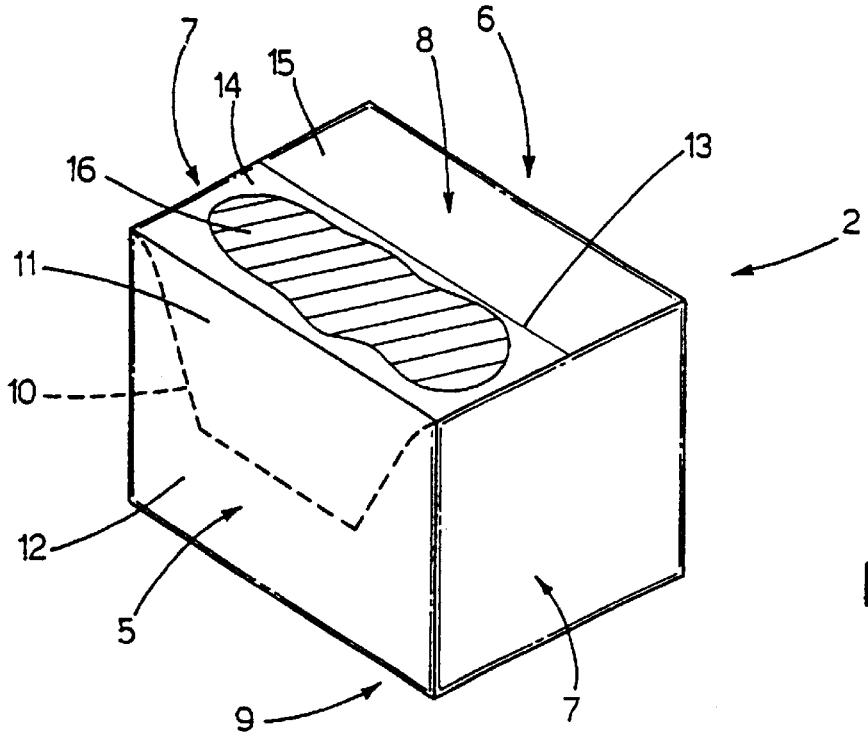
FIG. 3 is a perspective view of a rigid carton for cigarette packets made using the blank illustrated in FIG. 1 and in a closed configuration.

As illustrated in FIG. 3, the carton 2 is a parallelepiped and is delimited by a front wall 5, a rear wall 6 which is parallel with the front wall 5, two side walls 7 which are parallel with one another and at right angles to the front wall 5 and rear wall 6, a lid 8 which is at right angles to the front wall 5, the rear wall 6 and the side walls 7, and a base 9 which is parallel with the lid 8. A pre-cut tear line 10 divides the front wall 5 into an upper portion 11 which is substantially trapezoidal and a lower portion 12. A pre-weakened fold line 13 divides the lid 8 into two rectangular portions 14 and 15, the portion 14 being adjacent to the front wall 5.

The portion 14 bears FIGS. 16 or lettering or, in general, graphic symbols which allow, for example, immediate recognition of the brand of the cigarette packets 4 contained in the carton 2.

For greater clarity, where possible, the parts of the blank 1 are labelled using the same reference numbers which indicate the corresponding parts of the carton 2, but with the addition of a prime.

The blank 1 (FIG. 1) extends substantially longitudinally along a longitudinal axis 17 of symmetry. The blank 1 comprises a plurality of transversal pre-weakened fold lines 18, perpendicular with the longitudinal axis 17, and two longitudinal pre-weakened fold lines 19, parallel with the longitudinal axis 17 and on opposite sides of the longitudinal axis 17. The blank 1 is folded about these lines to form the carton 2. In particular, during formation of the carton 2, after folding the blank 1, the fold lines 18 and 19 form the edges of respective right dihedrals.

The longitudinal fold lines 19 divide the blank 1 into a central part 20 and two side parts 21 which are on opposite sides of the central part 20.

From the top downwards in FIG. 1, the transversal fold lines 18 divide the central part 20 into a panel 9', delimited at the sides by two folding segments 19*a*, a panel 5' delimited at the sides by two folding segments 19*b*, a panel 8' delimited at the sides by two segments 19*c* aligned with the longitudinal fold lines 19, a panel 6' delimited at the sides by two folding segments 19*d*, and a tab 22, which is delimited at the sides by two segments 19*e* aligned with the longitudinal fold lines 19 and designed so that during formation of the carton 2, it is attached to an inner surface of the panel 9'.

The panel 5' forms the front wall 5 and has a pre-cut tear line 10, which divides the panel 5' into a first portion 11' which is substantially trapezoidal, the bottom of which is attached to the panel 8', and a second portion 12', the top of which is attached to the panel 9'.

The panel 5' has two opposite vertices at the intersections of the segments 19b with the transversal fold line 18 between the panel 5' and the panel 8', and the tear line 10 extends along a path which links the two corners and comprises a central segment 10*a* which is parallel with the transversal fold lines 18 and two side segments 10*b* which extend at an angle to join the central segment 10*a* to the two vertices.

The pre-weakened fold line 13 divides the panel 8' into a first portion 14', the top of which is attached to the panel 5' and bears graphics 16, and a second portion 15', the bottom of which is attached to the panel 6'.

The blank 1 also comprises, along the sides 21, panels 7' positioned symmetrically on opposite sides of the panel 9' and attached to the panel 9' along the longitudinal folding segments 19*a*.

The blank 1 also comprises, along the sides 21, two tabs 23 positioned symmetrically on opposite sides of the panel 5' and attached to the panel 5' along the longitudinal folding segments 19*b*, and two tabs 24 located symmetrically on opposite sides of the panel 6' and attached to the panel 6' along the longitudinal folding segments 19*d*. During formation of the carton 2, the tabs 23 and 24 are attached to the panels 7', which form the side walls 7 of the carton 2.

Figure 5:
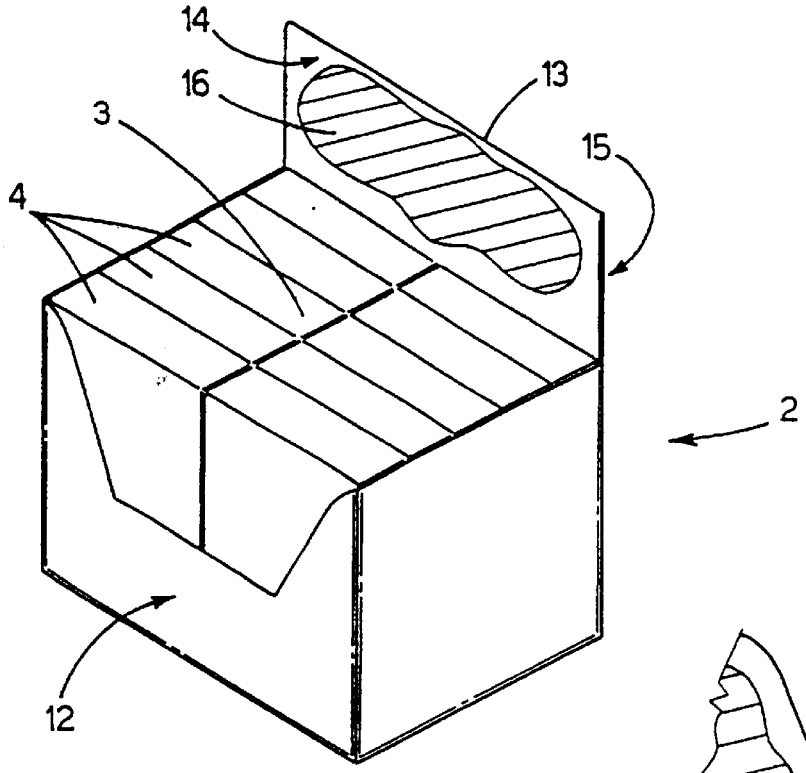
FIG. 5 is a perspective view of the rigid carton illustrated in FIG. 3 in an open configuration.

In practice, as illustrated in FIG. 5, the upper portion 11 of the front wall 5 of the carton 2 is separated from the lower portion 12 by tearing it away along the pre-cut line 10 and is tucked between one end of the group 3 of packets 4 and the rear wall 6, folding the lid 8 along the fold line 13 so that the graphics 16 on the portion 14 are facing the front wall 5.

Figure 2:
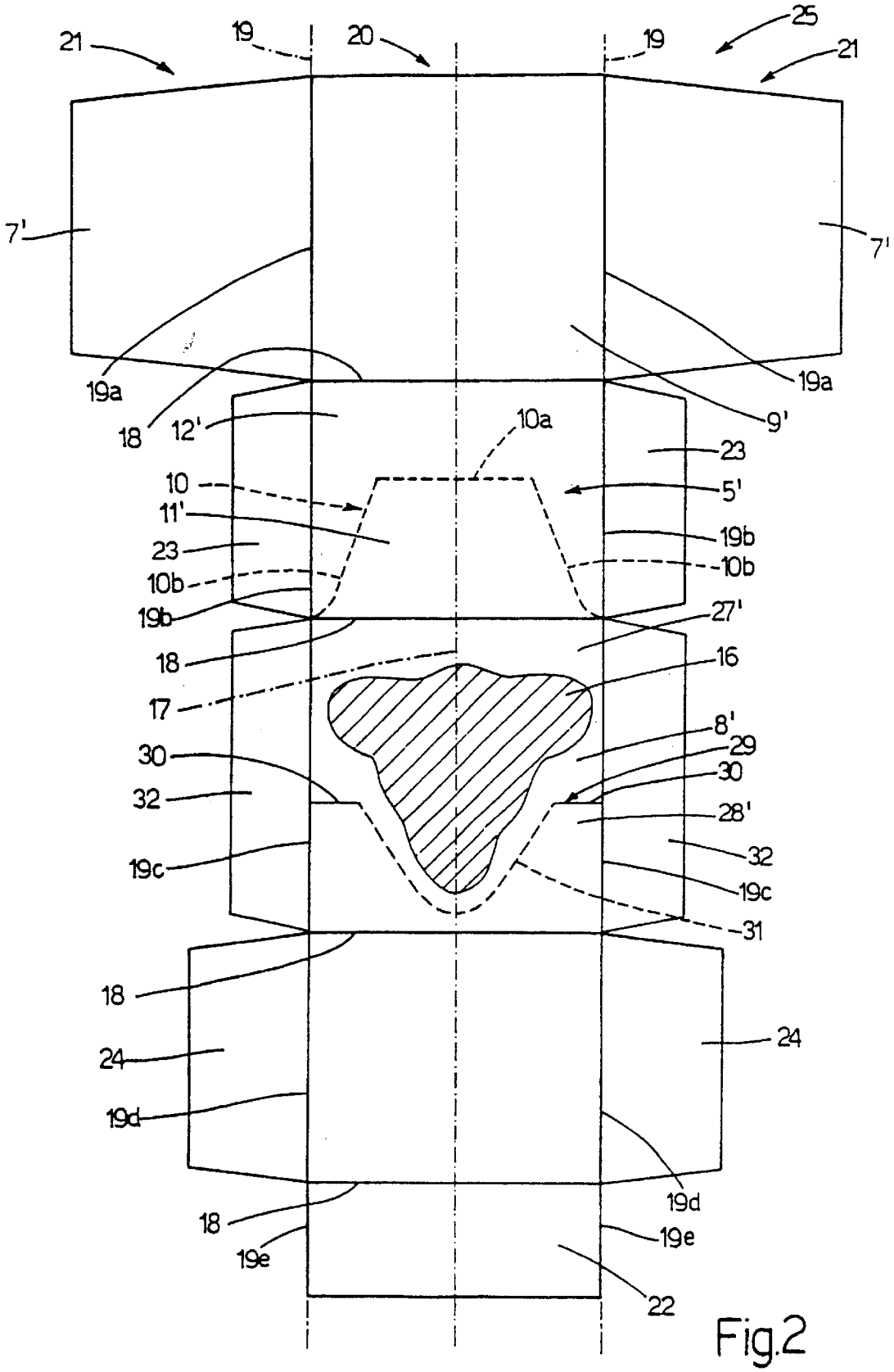
FIG. 2 is a plan view of a second embodiment of the blank made according to the present invention.
Figure 4:
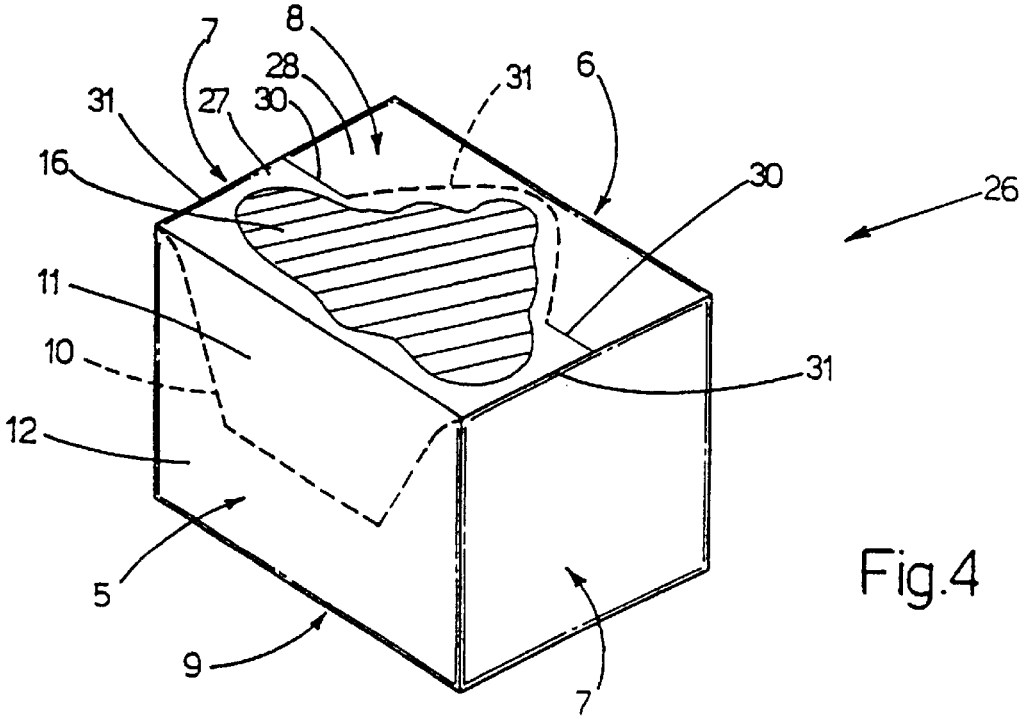
FIG. 4 is a perspective view of a rigid carton for cigarette packets made using the blank illustrated in FIG. 2 and in a closed configuration.

In the embodiment illustrated in FIG. 2, the numeral 25 denotes a flat blank made of cardboard or a similar material, which is folded in the known way to make a carton 26 (FIG. 4).

Since the blank 25 is very similar to the blank 1 shown in FIG. 1, where possible, the parts of the blank 25 are labelled with the same reference numbers as those used for the equivalent parts of the blank 1.

The blank 25 differs from the blank 1 in that its panel 8' is divided into two portions 27' and 28' by a pre-weakened fold line 29. The fold line 29 is formed by two side segments 30 which are parallel with transversal fold lines 18, and a pre-cut or cut central segment 31 which is substantially U-shaped.

In contrast to the blank 1, the blank 25 also comprises two tabs 32, located symmetrically on opposite sides of the panel 8' and attached to the panel 8' along the longitudinal folding segments 19*c*, which are preferably pre-cut.

Figure 7:
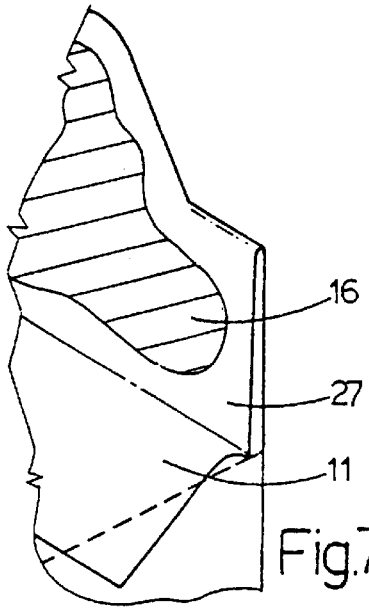
FIG. 7 is a detail from FIG. 6.
Figure 6:
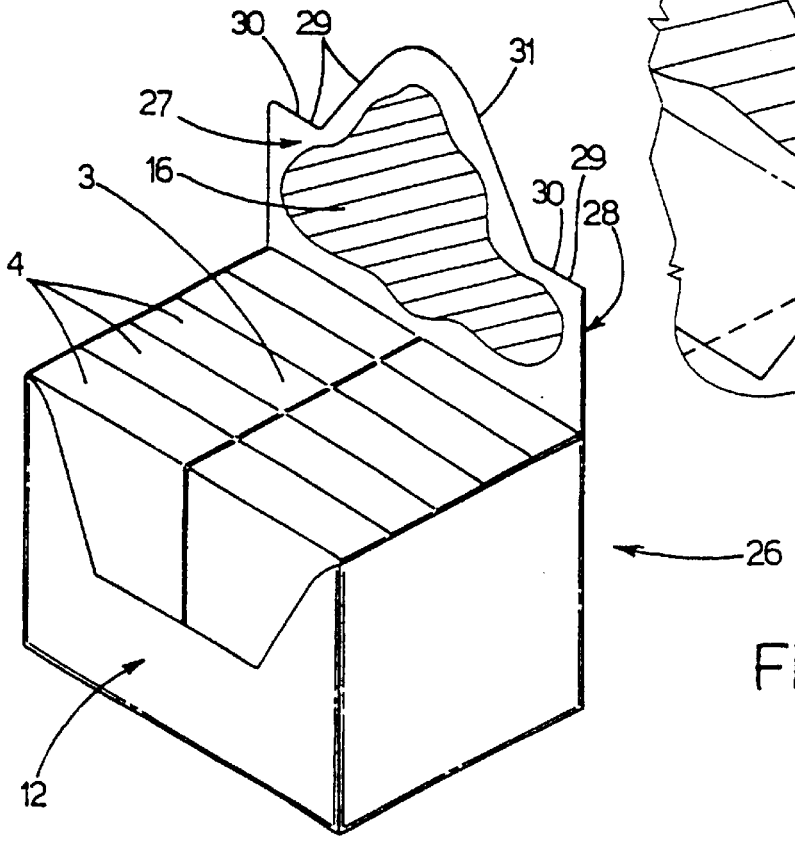
FIG. 6 is a perspective view of the rigid carton illustrated in FIG. 4 in an open configuration.

In operation, as illustrated in FIGS. 6 and 7, the upper portion 11 of the front wall 5 of the carton 26 is separated by tearing it away from the lower portion 12 and the lid 8 is separated by tearing it along the tab 32 folding segments 19*c* (FIG. 2), which are attached to the side walls 7 during carton 26 formation. The lid 8 is then folded along the side segments 30 of the line 29, separating the portion 27 from the portion 28 by tearing along the segment 31, if said segment is pre-cut. The lid 8 is folded in such a way that the graphics 16 face the front wall 5 of the carton 26. The portion 11 is then tucked between the rear end of the group 3 of packets 4 and the rear wall 6.

What is claimed is:

1. A flat blank for the formation of a rigid carton for cigarette packets, which is substantially a parallelepiped, comprising a front wall, a rear wall, two side walls, a lid and a base; the blank having a longitudinal axis and comprising a central part delimited by two longitudinal fold lines which are parallel with the longitudinal axis and two side parts located on opposite sides of the central part; the blank also comprising a set of transversal fold lines which divide the central part into a first panel which forms the base, a second panel which forms the front wall, a third panel which forms the lid and a forth panel which forms the rear wall; the blank also comprising a pre-weakened tear line which separates the second panel into a first substantially trapezoidal portion and a second portion; the third panel being divided by a fold line into a first portion adjacent to the second panel and a second portion adjacent to the fourth panel; and the side parts comprises two fifth panels located on opposite sides of the first panel, which form the side walls; the second panel having respective first vertices located on the longitudinal fold lines in contact with the third panel; wherein the pre-weakened line has a central segment which is parallel with the transversal fold lines, and two side segment, that join the central segment to the two first vertices.

2. The blank according to claim 1, wherein the first portion of the third panel bears at least one graphic symbol.

3. The blank according to claim 2, wherein side parts comprise two first tabs located on opposite sides of the second panel and being designed in such a way that, when folded, they attach the second panel to the fifth panels.

4. The blank according to claim 3, wherein the side parts comprise two second tabs located on opposite sides of the fourth panel being designed in such a way that, when folded, they attach the fourth panel to the fifth panels.

5. The blank according to claim 4, wherein the side parts comprise two third tabs located on opposite sides of the third panel being designed in such a way that, when folded, they attach the third panel to the fifth panels; the third tabs being attached to the third panel along respective pre-cut tear segments of the longitudinal fold lines.

6. The blank according to claim 5, wherein the central part comprises a fourth tab which is attached to the fourth panel and which is designed in such a way that, when folded, it attaches the fourth panel to the first panel.

7. The blank according to claim 6, wherein the fold line has a separable central portion which is pre-cut or separated.

8. The blank according to claim 7, wherein the fold line has two side folding segments which are parallel with the transversal fold lines, said side segments being joined by the central segment, and the central segment being substantially U-shaped.

9. The blank according to claim 1, wherein the side parts comprise two first tabs located on opposite sided of the second panel and being designed in a way that, when folded, they attach the second panel to the fifth panels.

10. The blank according to claim 1, wherein the side parts comprise two second tabs located on opposite sides of the fourth panel, being designed in such a way that, when folded, they attach the fourth panel to the fifth panels.

11. The blank according to claim 1, wherein the side parts comprise two third tabs located on opposite sides of the third panel, being designed in such a way that, when folded, they attach the third panel to the fifth panels; the third tabs being attached to the third panel along respective pre-cut tear segments of the longitudinal fold lines.

12. The blank according to claim 1, wherein the central part comprises a fourth tab which is attached to the fourth panel and which is designed in such a way that, when folded, it attaches the fourth panel to the first panel.

13. The blank according to claim 1, wherein the fold line has a separable central portion which is pre-cut or separated.

14. The blank according to claim 13, wherein the fold line has two side folding segments which are parallel with the transversal fold lines, said side segments being joined by the central segment, and the central segment being substantially U-shaped.

* * * * *